United States Patent [19]

Montealegre

[11] 4,274,578

[45] Jun. 23, 1981

[54] CARTON WITH TWO COMPARTMENTS AND BLANK FOR FORMING SAME

[76] Inventor: James Montealegre, 2045 Christensen Ave., #332, W. St. Paul, Minn. 55118

[21] Appl. No.: 137,238

[22] Filed: Apr. 4, 1980

[51] Int. Cl.[3] ..... B65D 5/50; B65D 5/48

[52] U.S. Cl. ..... 229/27

[58] Field of Search ..... 229/27, 42, 28, 15, 229/39 B; 206/45.31, 45.14

[56] References Cited

U.S. PATENT DOCUMENTS

| | | | |
|---|---|---|---|
| 2,643,811 | 6/1953 | Bolding | 229/27 |
| 3,370,776 | 2/1968 | Krzyzanowski | 229/27 |
| 3,539,089 | 11/1970 | Osberg | 229/27 |
| 3,701,415 | 10/1972 | Tuitt | 229/39 B |
| 3,946,935 | 3/1976 | Bomczyk | 229/15 X |
| 4,113,086 | 9/1978 | Forbes, Jr. | 229/15 |
| 4,125,185 | 11/1978 | Bliss | 229/42 |

*Primary Examiner*—Davis T. Moorhead
*Attorney, Agent, or Firm*—Evelyn M. Sommer

[57] ABSTRACT

A carton with two compartments and a blank for forming same has a collapsible divider panel hingedly coupled to interior surfaces of two adjacent side walls of the carton. The divider panel has a fold line extending from the corner thereof at the fold line between the two adjacent wall panels and extending at acute angles relative to the hinged edges of the divider panel. This permits the carton to be shipped and stored in an essentially flat, collapsed configuration and then easily rearranged to its assembled, expanded configuration by the application of inwardly directed forces against the side edges of the flat, collapsed configuration of the carton. These forces cause the divider panel to move automatically with the movement of the side wall panels of the carton.

9 Claims, 8 Drawing Figures

CARTON WITH TWO COMPARTMENTS AND BLANK FOR FORMING SAME

BACKGROUND OF THE INVENTION

1. Field Of The Invention

The present invention relates to a carton with two compartments and a blank for forming the carton. More particularly, the invention relates to a collapsible divider panel structure which permits shipment of the partially assembled carton in a flat, collapsed configuration, while allowing complete assembly and set up by a simple manual operation without the use of glue during final assembly.

2. Description Of The Prior Art

In constructing cartons or containers for certain articles, it is often necessary to provide two separated compartments within the carton, each of which is separately accessable from an opposite end of the carton. This permits each compartment to be opened separately from its respective ends, without opening the other compartment. Thus, two separate articles may be placed within the carton permitting one to be removed while the other article remains securely entrapped within its respective compartment.

U.S. Pat. No. 4,125,185 to Bliss discloses a carton having two longitudinal compartments with each compartment divided by a transversely extending shelf. This carton is not collapsible so that it may not be shipped and stored in a partially assembled, collapsed configuration, and then completely assembled or set up by a simple, quick manual operation without the use of glue.

SUMMARY OF THE INVENTION

Since the carton manufacturer may be located far from where the articles are packed within the carton, the carton must be capable of being shipped and stored in a flat, collapsed configuration to use shipping and storage space efficiently. Otherwise, the carton would waste conderables pace and prevent economical shipment and storage.

Once at the packing location, the partially assembled carton must be capable of full assembly easily without the use of skilled personnel or complex machinery. Thus, the action necessary to convert the carton from its partially assembled, collapsed configuration to its fully assembled state must be extremely quick and simple.

Accordingly, it is an object of the present invention to provide a carton and a blank for forming a carton with two compartments which is collapsable so that the carton may be shipped and stored in a flat, partially assembled, collapsed configuration.

Another object of the present invention is to provide a carton and a blank for forming a carton with two compartments that may be simply and quickly converted from a partially assembled, collapsed configuration to a fully assembled configuration without skilled personnel and without complex folding and gluing machinery.

An additional object of the present invention is to provide a carton and a unitary blank for forming a carton with two compartments which is of rugged construction and which is simple and inexpensive to manufacture, assemble and use.

The foregoing objects ae obtained by providing a carton with two compartments, comprising a plurality of wall panels hingedly coupled at adjacent edges thereof along fold lines, and a collapsible divider panel hingedly coupled at an end edge thereof by a first means to an interior surface of a first of the wall panels and at a side edge thereof by a second means to an interior surface of a second of the wall panels adjacent to the first wall panel, the end and side edges of the divider panel meeting at a corner thereof, the divider panel having a fold line formed therein and extending from the divider panel corner at acute angles to the side and end edges.

The foregoing objects are also attained by a planar, unitary blank for forming a carton with two compartments, comprising a rectangular front panel, first and second rectangular side panels of substantially equal size hingedly coupled to opposed side edges of the front panel along fold lines, a rectangular back panel hingedly coupled to a side edge of the first side panel remote from the front panel along a fold line, the front and back panels being substantially equal in size, a glue flap hingedly coupled to a side edge remote from the front panel of one of the back and second side panels along a fold line, a side edge of the other of the back and second side panels defining a free edge, a spacer panel hingedly coupled to an end edge of one of the panels along a fold line, and a divider panel hingedly coupled to the spacer panel at an end edge thereof remote from the one panel along a fold line, the divider panel having first and second portions separated by a fold line formed in the divider panel and extending from one end of the fold line between the pacer and divider panels.

By forming the carton and blank of the present invention in this manner, a carton with two compartments may be provided which may be partially formed and shipped in a flat, collapsed configuration and then easily and simply rearranged to a fully assembled configuration in which the carton has two compartments, one at each longitudinal end thereof. The rearrangement is accomplished by a simple manipulation without gluing, complex machinery or skilled personnel. Thus, the present invention permits cartons formed with two longitudinal compartments to be easily and economically manufactured shipped and stored.

Other objects, advantages and salient features of the present invention will become apparent from the following detailed description, which taken in conjunction with the annexed drawings, discloses a preferred embodiment of the present invention.

As used in this application, the terms "first", "second", "front", "back", "side", "end", "top" and "bottom", are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
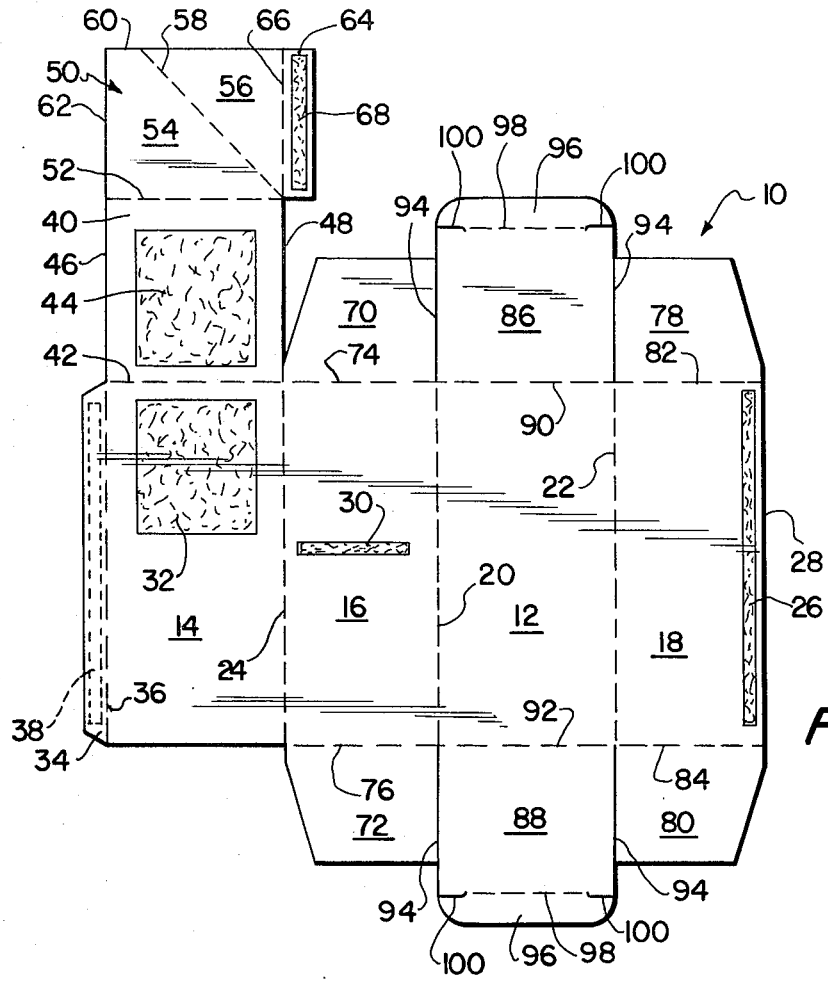
FIG. 1 is a plan view illustrating the interior surface of a blank for forming a carton in accordance with the present invention.

Referring to FIG. 1, the blank 10 may be formed of a unitary piece of paperboard of suitable weight and thickness. The weight and thickness of the paper depends on the size and weight of the article contained within the carton. FIG. 1 illustrates the surface of the blank which will form the interior surface of the carton illustrated in FIGS. 7 and 8.

The main portion of the blank 10 comprises rectangular front and back panels 12, 14 and rectangular side panels 16, 18. The first side panel 16 is hingedly coupled to the front panel 12 at one side edge thereof along a fold line 20. The second side panel 18 is hingedly coupled to the front panel 12 at an opposite side edge thereof along a fold line 22. The back panel 14 is hingedly coupled to the first side panel 16 at a side edge thereof remote from the front panel 12 along a fold line 24. The front and back panels 12, 14 are of substantially equal size, and side panels 16, 18 are of substantially equal size.

The second side panel 18 has a glue area 26 on the interior surface thereof adjacent the free side edge 28 of the panel 18. The first side panel 16 has a glue area 30 on the interior surface thereof extending perpendicular to the fold lines 20, 24. The glue area 30 is offset so as to be closer to the fold line 24 than the fold line 20 and is located between the top and bottom ends of the panel 16 with the lower edge of the glue area 30 substantially half the distance between the top and bottom ends of the panel 16. The back panel 14 has a glue area 32 located on the interior surface thereof adjacent its upper end.

A trapezoidal glue flap 34 is hingedly coupled at its longer parallel base to the side edge of the back panel 14 remote from the front panel 12 and the first side panel 16 along a fold line 36. The glue glap 34 has a glue area 38 on the exterior surface thereof shaped and located to mate with the glue area 26 on the second side panel 18.

A rectangular spacer panel 40 is hingedly coupled at its bottom end edge to the top end edge of the back panel 14 along the fold line 42. A glue area 44 is provided on one surface of the spacer panel 40 oriented and shaped to mate with the glue area 32 on the back panel 14 when the panels 40, 14 are folded about the fold line 42. The side edges 46, 48 of the spacer panel 14 are substantially colinear with the fold lines 36, 24, respectively.

A rectangular divider panel 50 is hingedly coupled to the top end edge (that edge remote from the back panel 14) of the spacer panel 40 along the fold line 52. The divider panel 50 is divided into first and second portions 54, 56 by the fold line 58 formed in the divider panel 50. The fold line 58 extends from the end of the fold line 52 adjacent the side edge 48, at an acute angle of approximately 45° relative to the fold line 52, to the free top end edge 60 (i.e., that end edge remote from the spacer panel 40) of the divider panel 50. One side edge 62 of the divider panel 50 is colinear with the side edge 46 of the spacer panel 40.

The other side edge of the divider panel 50 has a glue panel 64 hingedly coupled thereto along a fold line 66. The glue panel 64 is rectangular and has a glue area 68 on the interior surface thereof. The fold line 66 is substantially colinear with the side edge 48 of the spacer panel 40 and with the fold line 24 between the back and first side panels 14, 16. The fold line 66 extends from the juncture of the fold lines 52, 58 at the adjacent corners of the divider panel 50, the spacer panel 40 and the glue panel 64.

The spacing between the fold line 52 and the end edge 60 of the divider panel 50 is somewhat less than the width of the side panels 16, 18 between the fold lines 24, 20 and the fold line 22 and the side edge 28, respectively.

The first side panel 16 has top and bottom flaps 70, 72 hingedly coupled to the top and bottom edges of the panel 16 along fold lines 74, 76, respectively. Similarly, the second side panel 18 has top and bottom flaps 78, 80 hingedly coupled to the top and bottom end edges of the panel 18 along fold lines 82, 84, respectively. The flaps 70, 72, 78, 80 are of conventional configuration and size.

The front panel 12 has top and bottom cover panels 86, 88 hingedly coupled to the top and bottom edges thereof along fold lines 90, 92. The cover panels 86, 88 are generally rectangular in configuration and have slits 94 extending along the side edges thereof to separate the panels 86, 88 from the adjacent side edges of the flaps 70, 72, 78, 80. The ends of the cover panels 86, 88 remote from the front panel 12 have tuck flaps 96 hingedly coupled thereto along fold lines 98. Each end of each fold line 98 has a slit 100.

Figure 2:
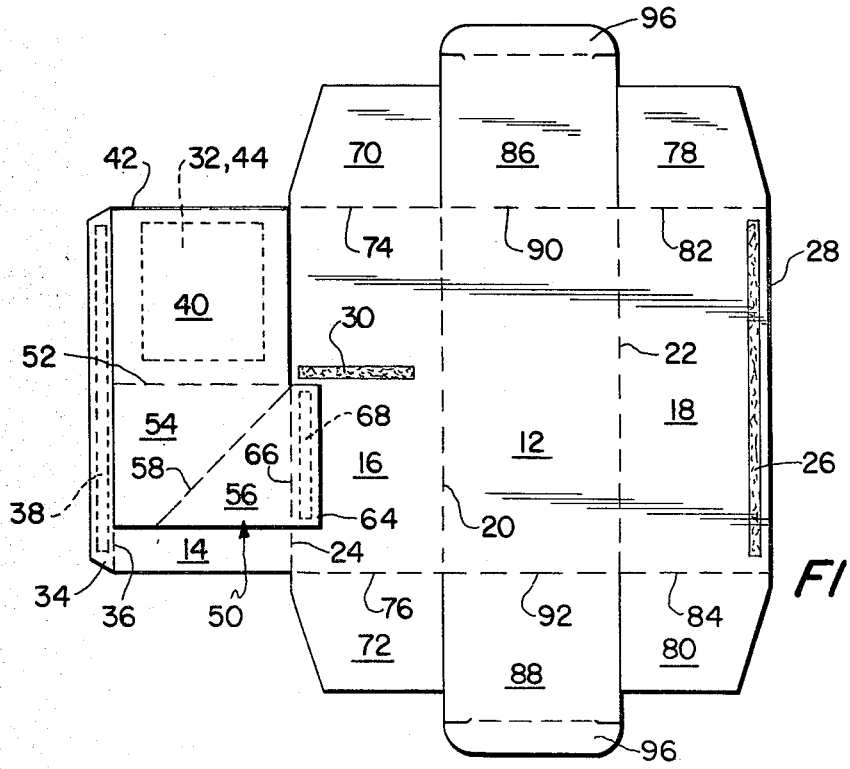
FIGS. 2, 3 and 4 are plan views illustrating the blank of FIG. 1 in various stages of folding and gluing.

The carton 102 (illustrated in FIG. 7) is formed from the blank 10 of FIG. 1 by folding the spacer panel 40 about line 42 to a position in which the spacer panel 40 overlies the interior surface of the back panel 14. The divider panel 50 and the glue panel 64 remain coplanar with the spacer panel 40. In this position illustrated in FIG. 2, the glue area 32 on the back panel 14 mates with the glue area 44 on the spacer panel 40. The adhesive on the glue area 32 and/or glue area 44 fixes the spacer panel 40 to the interior surface of the back panel 14.

Figure 3:
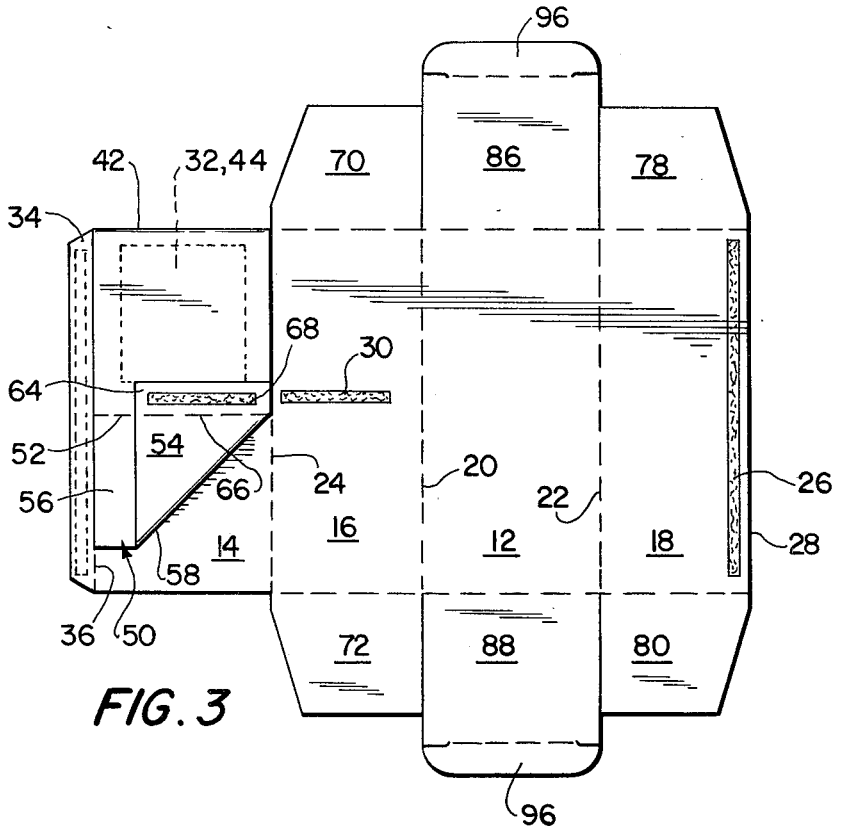

As illustrated in FIG. 3, the first divider panel portion 54 is folded relative to the second divider panel portion 56 about the fold line 58. The glue panel 64 remains coplanar with the portion 56. In this position, the glue areas 68 and 30 are aligned and exposed. The portion 54 is folded about the fold line 58 until it overlies the surface of the portion 56 facing away from the back panel 14. It should be noted that the steps of FIGS. 2 and 3 may be reversed.

Figure 4:
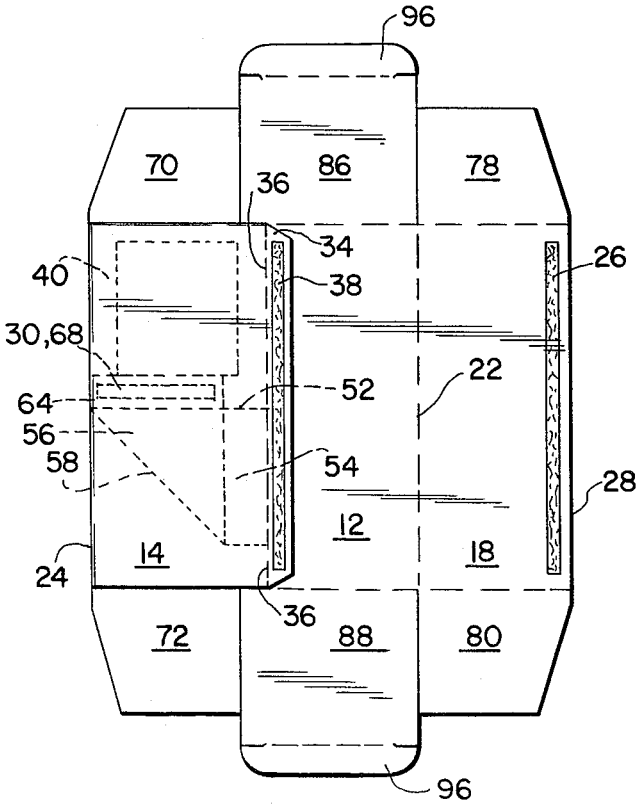

Once the blank has been properly positioned as illustrated in FIG. 3, back panel 14 is folded about line 24 with respect to the first side panel 16 until the spacer panel 40 and the divider panel 50 overlie the interior surface of the second side panel 16 as illustrated in FIG. 4. In this position, the glue areas 68, 30 mate. The adhesive on the area 30 and/or the area 68 fixes the glue panel 64 to the interior surface of the first side panel 16 to hingedly couple the first side panel 16 and the divider panel 50.

After the back panel 14 and the first side panel 16 have been folded to the position of FIG. 4, the second side panel 18 is folded about line 22 until the interior surface of panel 18 overlies the interior surface of the front panel 12 and the glue flap 34 lying thereon. In this position, the glue areas 26, 38 mate and the free side edge 28 of the panel 18 overlies the fold line 36 of the glue flap 34. The adhesive applied to area 26 and/or area 38 fixes the glue flap 34 to the interior surface of the panel 18 to hingedly coupled the panels 14, 18 along the fold line 36.

Figure 5:
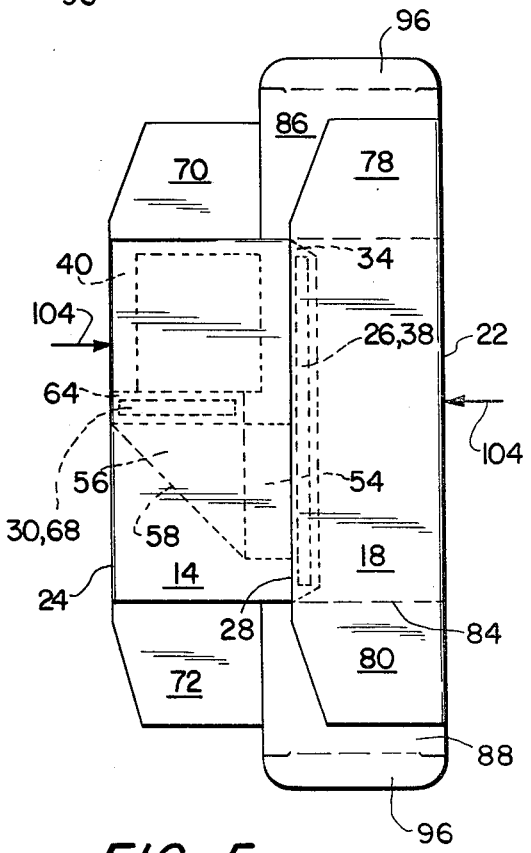
FIG. 5 is a plan view illustrating the blank of FIG. 1 after it has been folded and glued to its partially assembled, collapsed configuration.

The blank 10 is now in the configuration illustrated in FIG. 5. This configuration represents the partially assembled, flat, collapsed configuration of the carton 102 in which it may be shipped, stored and fully assembled simply, inexpensively and efficiently.

Figure 8:
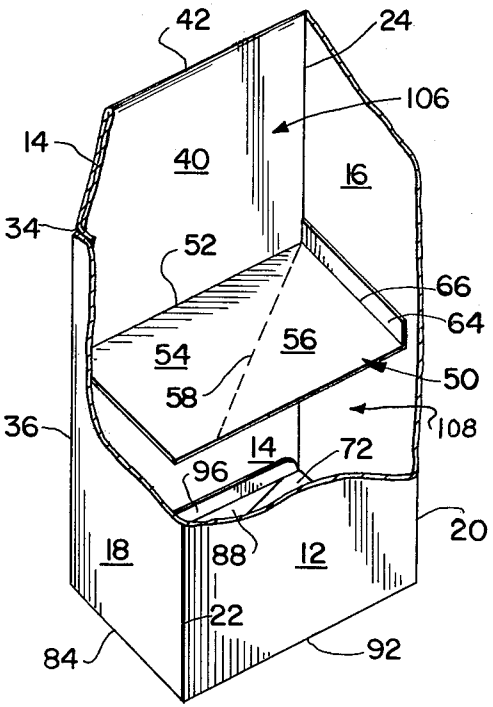
FIG. 8 is a perspective view, partially sectioned, illustrating the carton of FIG. 7.
Figure 7:
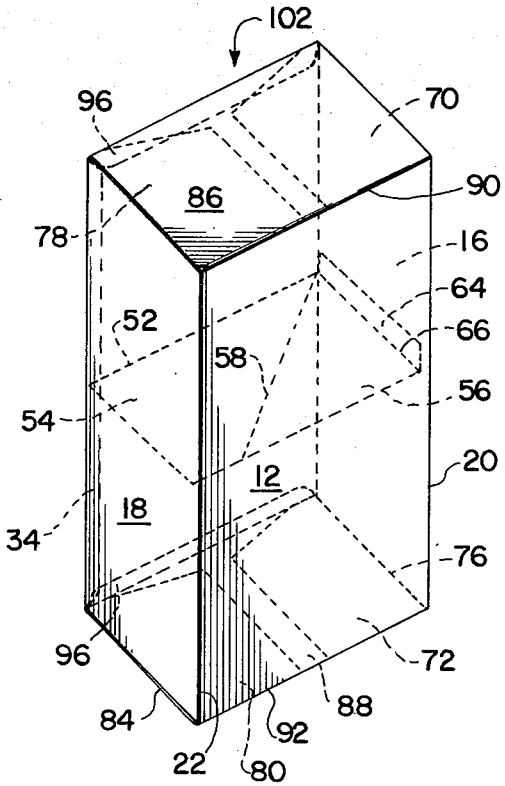
FIG. 7 is a perspective view illustrating the carton of the present invention in its fully assembled, closed configuration.
Figure 6:
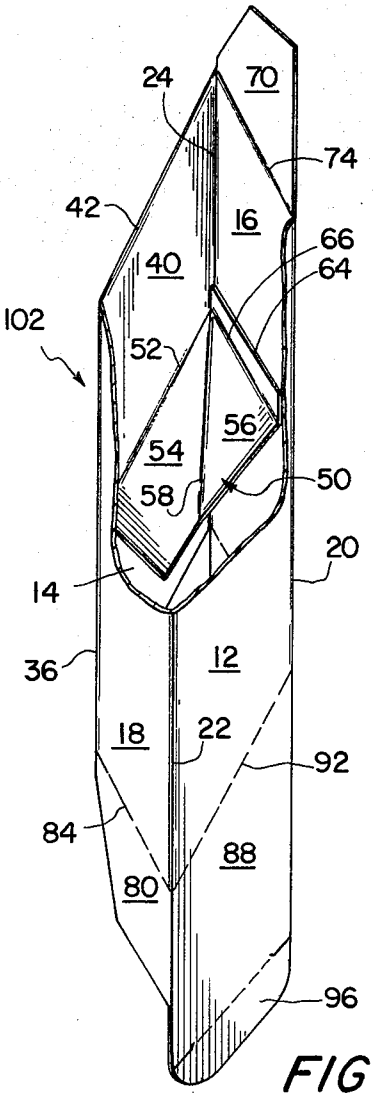
FIG. 6 is a perspective view, partially sectioned, illustrating the carton formed from the blank of FIG. 1 in a partially collapsed configuration.

The fully assembled configuration of FIG. 7 is achieved from the partially assembled, collapsed configuration of FIG. 5 by applying opposing forces, represented by arrows 104, against the side edges (i.e., fold lines 22, 24) of the FIG. 5 configuration. As illustrated in FIG. 6, these forces cause the carton 102 to open up or expand with the panels 12, 14, 16, 18 pivoting about fold lines 20, 22, 24, 36 away from their collapsed position to a position in which the front and back panels 12, 14 are parallel, and the side panels 16, 18 are parallel to each other and perpendicular to the front and back panels 12, 14 as illustrated in FIGS. 7 and 8. As the panels 12, 14, 16, 18 are pivoting to a fully assembled position to form the side walls of the carton 102, the divider panel 50 automatically opens to its assembled orientation in which the portions 54, 56 are coplanar and are perpendicular to the panels 12, 14, 16, 18. The first divider panel portion 54 pivots about the fold line 52 relative to back panel 14 and spacer panel 40. The second divider panel portion 56 pivots about the fold line 66 relative to side panel 16. The portions 54, 56 pivot relative to each other about the fold line 58. The portions 54, 56 pivot generally upwardly from the FIG. 5 configuration, through the intermediary FIG. 6 configuration, to the fully assembled configuration illustrated in FIGS. 7 and 8.

The carton 102 is retained within the fully assembled configuration of FIGS. 7 and 8 against the inherent bias or tendency of the carton to resume the collapsed configuration of FIG. 5 by the closing of the ends of the carton 102. After the panels 12, 14, 16, 18, 50 have been pivoted to their fully assembled orientation, the flaps 70, 72, 78, 80, the cover panels 86, 88 and the tuck flaps 96 are still coplanar with their respective panels. The top end opening is closed by pivoting the first and second top flaps 70, 78 about the fold lines 74, 82, respectively, until such flaps are substantially perpendicular to the side panels 16, 18, respectively. Thereafter, the top cover panel 86 is folded about line 90 until it overlies the flaps 70, 78 and is perpendicular to the front panel 12, while simultaneously inserting its tuck flap 96 between the spacer panel 40 and the side edges of the flaps 70, 78 adjacent thereto. Similarly, the bottom end opening of the carton is closed by pivoting the flaps 72, 80 about the fold lines 76, 84, respectively, until such flaps are perpendicular to the side panels 16, 18. Thereafter, the bottom cover panel 88 is pivoted about fold line 92 unit it is perpendicular to the front panel 12 and overlies the flap 72, 80, while simultaneously inserting its tuck flap 96 between the interior surface of the back panel 14 and the side edges of the flaps 72, 80 adjacent thereto.

As illustrated in FIGS. 7 and 8, the divider panel 50 separates the carton into two compartments 106, 108. The upper compartment is defined between the top cover panel 86 and the divider panel 50, while the lower compartment 108 is defined between the divider panel 50 and the bottom cover panel 88. Separate articles may be separately placed within the compartments 106, 108 prior to closing of the ends of the carton as described hereinabove.

If desired, the carton 102 may be again arranged in the collapsed configuration of FIG. 5 once the contents thereof have been removed, by opening up the ends of the carton and applying inwardly directed forces against the edges of the carton 102 formed by the fold lines 20, 36. This will cause both the divider panel 50 and the panels 12, 14, 16, 18 to assume their flat, collapsed configuration of FIG. 5.

By forming and folding the blank 10 and the carton 102 in this manner, the carton 102 may be shipped and stored in a substantially flat, collapsed configuration. The flat, collapsed carton may then be easily and simply formed into a fully assembled carton having two separate compartments 106, 108 separated by a transverse divider panel 50 by simply applying force to the edges of the carton formed by the fold lines 22, 24. Thus, when the carton is to be packed, the packer receives the carton in its collapsed configuration and then simply assembles it without gluing, complex machinery or skilled personnel.

Additionally, once the articles have been placed within the carton 102, each article may be separately exposed and removed by opening up the appropriate cover panel and flaps without affecting the packaging of the other article.

While a particular embodiment has been chosen to illustrate the invention, it will be understood by those skilled in this art that various changes and modifications can be made therein without departing from the scope of the invention as defined in the appended claims.

What is claimed is:

1. A carton with two compartments, comprising:

a plurality of wall panels hingedly coupled at adjacent edges thereof along fold lines; and a collapsible divider panel hingedly coupled at an end edge thereof by a first means to an interior surface of a first of said wall panels and at a side edge thereof by a second means to an interior surface of a second of said wall panels adjacent to said first wall panel, said end and side edges of said divider panel meeting at a corner thereof, said divider panel having a fold line formed therein and extending from said divider panel corner at acute angles to said side and end edges.

2. A carton according to claim 1, wherein said first means comprises a spacer panel hingedly coupled at opposite end edges thereof to one end edges of said first wall panel and said divider panel along fold lines, and fixed to said interior surface of said first wall panel.

3. A carton according to claim 2, wherein said spacer panel is fixed to said first wall panel by an adhesive.

4. A carton according to claim 2, wherein said spacer panel is generally rectangular with a dimension perpendicular to the fold lines thereof substantially equal to the desired spacing of said divider panel from said one end edge of said first wall panel coupled thereto.

5. A carton according to claim 1, wherein said second means comprises a glue panel hingedly coupled to said divider panel at said side edge thereof along a fold line and fixed to said interior surface of said second wall panel.

6. A planar, unitary blank for forming a carton with two compartments, comprising:

a rectangular front panel;

first and second rectangular side panels of substantially equal size hingedly coupled to opposed side edges of said front panel along fold lines;

a rectangular back panel hingedly coupled to a side edge of said first side panel remote from said front panel along a fold line, said front and back panels being of substantially equal size;

a glue flap hingedly coupled to a side edge remote from said front panel of one of said back and second side panels along a fold line, a side edge at the other of said back and second side panels defining a free edge;

a spacer panel hingedly coupled to an end edge of one of said panels along a fold line; and a divider panel hingedly coupled to said spacer panel at an end edge thereof remote from said one panel along a fold line, said divider panel having first and second portions separated by a fold line formed in said divider panel and extending from one end of the fold line between said spacer and divider panels.

7. A planar, unitary blank according to claim 6, wherein a glue panel is hingedly coupled to a side edge of one of said divider panel portions along a fold line extending from said one end of said fold line between said spacer and divider panels.

8. A planar, unitary blank according to claim 7, wherein said fold lines between said glue and divider panels, said divider panel portions, and said spacer and divider panels meet at adjacent corners of said glue, divider and spacer panels.

9. A planar, unitary blank according to claim 7, wherein said spacer panel is coupled to said back panel and the fold line between said glue and divider panels is substantially colinear with the fold line between said back and first side panels.

* * * * *

UNITED STATES PATENT AND TRADEMARK OFFICE

CERTIFICATE OF CORRECTION

PATENT NO. : 4,274,578

DATED : June 23, 1981

INVENTOR(S) : James Montealegre

It is certified that error appears in the above—identified patent and that said Letters Patent is hereby corrected as shown below:

On The Title Page insert,

-- 73 Assignee: Champion International Corporation, Stamford, Conn. --.

Col. 1, line 40 - delete "conderables" (our mistake) and insert in lieu thereof --considerable--.

Col. 1, line 40 - delete "pace" and insert in lieu thereof --space--.

Col. 1, line 66 - delete "ae" and insert in lieu thereof --are--.

Col. 2, line 31 - delete "pacer" and insert in lieu thereof --spacer--.

Col. 3, line 47 - delete "glap" and insert in lieu thereof --flap--.

Col. 5, line 59 - delete "unit" and insert in lieu thereof --until--.

Signed and Sealed this

*Second* Day of *February 1982*

[SEAL]

*Attest:*

GERALD J. MOSSINGHOFF

*Attesting Officer*

*Commissioner of Patents and Trademarks*